US006979068B2

(12) United States Patent
Kanematsu

(10) Patent No.: US 6,979,068 B2
(45) Date of Patent: Dec. 27, 2005

(54) PRINTING APPARATUS AND CONTROL METHOD THEREOF

(75) Inventor: Daigoro Kanematsu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 193 days.

(21) Appl. No.: 10/646,411

(22) Filed: Aug. 22, 2003

(65) Prior Publication Data

US 2004/0100513 A1 May 27, 2004

(30) Foreign Application Priority Data

Aug. 23, 2002 (JP) ..... 2002-243839

(51) Int. Cl.[7] ..... B41J 29/38; B41J 2/205
(52) U.S. Cl. ..... 347/9; 347/15; 347/41
(58) Field of Search ..... 347/9, 15, 43, 347/41, 19; 358/1.2, 1.9, 502, 517

(56) References Cited

U.S. PATENT DOCUMENTS

| | | | |
|---|---|---|---|
| 4,313,124 A | 1/1982 | Hara | |
| 4,345,262 A | 8/1982 | Shirato et al. | |
| 4,459,600 A | 7/1984 | Sato et al. | |
| 4,463,359 A | 7/1984 | Ayata et al. | |
| 4,558,333 A | 12/1985 | Sugitani et al. | |
| 4,723,129 A | 2/1988 | Endo et al. | |
| 4,740,796 A | 4/1988 | Endo et al. | |
| 6,278,469 B1 * | 8/2001 | Bland et al. | 347/19 |

FOREIGN PATENT DOCUMENTS

| | | | |
|---|---|---|---|
| EP | 863004 A2 * | 9/1998 | B41J 2/04 |
| JP | A 54056847 | 5/1979 | |
| JP | A 59123670 | 7/1984 | |
| JP | A 59138461 | 8/1984 | |
| JP | A 60071260 | 4/1985 | |
| JP | A 61123545 | 6/1986 | |
| JP | A 10258526 | 9/1998 | |
| JP | A 11000988 | 1/1999 | |
| JP | A 11077986 | 3/1999 | |
| JP | A 2001063008 | 3/2001 | |

* cited by examiner

*Primary Examiner*—Lamson Nguyen
(74) *Attorney, Agent, or Firm*—Morgan & Finnegan, LLP

(57) ABSTRACT

A printing apparatus which performs printing using a printhead having plural printing elements. Print data corresponding to a defective nozzle is added to print data corresponding to an adjacent normal nozzle, then the print data corresponding to the defective nozzle is masked, and printing is performed based on the print data corresponding to the normal nozzle as a result of addition and the masked print data corresponding to the defective nozzle. An image printing operation is performed by preferably 1-path printing. Further, preferably, the print data corresponding to the defective nozzle is sequentially distributed between data corresponding to two adjacent normal nozzles. Otherwise, on/off states of the data corresponding to the two adjacent normal nozzles are detected then the print data corresponding to the defective nozzle is distributed based on the result of detection.

17 Claims, 9 Drawing Sheets

PRINTING APPARATUS AND CONTROL METHOD THEREOF

CLAIM OF PRIORITY

The present application claims priority under 35 U.S.C. §119 from Japanese Patent Application No. 2002-243839, entitled "A Printing Apparatus and A Control Method Thereof" and filed on Aug. 23, 2002, the entire contents of which are hereby incorporated by reference herein.

FIELD OF THE INVENTION

The present invention relates to a printing apparatus which performs printing using a printhead with plural printing elements and its control method.

BACKGROUND OF THE INVENTION

A serial scanning type printing apparatus which performs printing by scanning a printhead on a print medium is applied to various image formation. Particularly, in recent years, a printing apparatus based on an ink-jet method is widely used since it is capable of high-resolution color printing to attain an image with greatly-improved image quality.

In the ink-jet printing apparatus, a high-resolution image printing can be realized by increasing the integration density of nozzles to discharge ink droplets while reducing the amount of ink discharge per 1 dot. Further, the reduction of printing speed, as a matter of concern accompanying the improvement in image quality, is excellently prevented by use of multiple printing elements, improvement in driving frequency, or use of, e.g., bidirectional printing of performing printing upon forward scanning and backward scanning of the printhead.

In the printhead including multiple printing elements, a defective printing element (hereinbelow, also referred to as a "defective channel") occurs in correspondence with frequency of use.

Further, as the number of arrayed printing elements in a high integration density increases, the probability of existence of defective printing element increases upon head manufacturing time. Further, in a case where elements for plural colors are integrally formed for prevention of color shift and improvement of operability, the probability further increases. Even when many printing elements are normal, only 1 defective printing element degrades the image quality.

As countermeasures against the above inconvenience, proposed are various methods for detecting a defective printing element and recovery methods or printing methods in correspondence with the result of detection. Japanese Published Unexamined Patent Application Nos.61-123545, 11-000988, 11-077986, 10-258526 and 2001-063008 disclose countermeasures against a case where the printhead includes a defective printing element.

Japanese Published Unexamined Patent Application No. 61-123545 discloses a method of print-outputting image data corresponding to a defective channel by a normal channel mainly by 1-path printing. When a carriage performs printing in a rightward direction, normal printing is performed, and when the carriage moves in a leftward direction, paper feeding is performed by an integral multiple of 1 pixel, for substitutional printing for a pixel which has not printed by a defective printing element by another normal printing element, then the portion of the defective channel is complemented by the normal channel. According to this method, originally 1-path printing is performed but substantially 2-path printing is performed upon substitutional printing.

Further, Japanese Published Unexamined Patent Application No. 11-077986 discloses, in consideration of the life of a complement nozzle on the complementary printing side, counting the frequency of use of the complement nozzle, and when the total frequency of use becomes a predetermined value, sequentially replacing the complement nozzle with a new nozzle. According to this method, substantially 2-path printing is performed upon substitutional printing as in the case of Japanese Published Unexamined Patent Application No. 61-123545.

Further, Japanese Published Unexamined Patent Application No. 11-000988 discloses setting n/m printing elements, obtained by dividing n elements by a submultiple m of the number of nozzles, as first printing elements, on the other hand, setting n(m−1)/m printing elements as second printing elements not used in normal print scanning, and only when the first printing element is defective, operating the second printing element as a substitutional printing element. This arrangement is premised on multipath printing of completing an image by performing print scanning and paper feed m times basically on the same image area.

Further, Japanese Published Unexamined Patent Application No. 10-258526 discloses completely replacing defect data of one nozzle with data of another nozzle. According to this method, a reference mask is obtained prior to printing, then a defective nozzle is specified, and a substitute nozzle is selected based on the position of the defective nozzle. Thereafter, print data is deleted from the mask of the defective nozzle, and the print data is added to the mask of the substitute nozzle. This method is premised on multipath printing as in the case of Japanese Published Unexamined Patent Application No. 11-000988.

Further, Japanese Publish d Unexamined Patent Application No. 2001-063008 discloses complementing by a printing element parallel to a defective printing element in a print scanning direction. According to this method, a black defective printing element is complemented by cyan, magenta and yellow printing elements.

However, in the countermeasures against a case where the printhead includes a defective printing element as described above, as the number of paths is increased or printing is premised on multipath printing for complementary printing, the throughput is degraded. Further, the method of complementary printing in Japanese Published Unexamined Patent Application No. 2001-063008 premised on 1-path printing, in a case where a dot to be complemented is not conspicuous such as a black dot, there is no problem, however, if a complemented dot is conspicuous such as a cyan, magenta or yellow dot complemented by another color, the technique is not applicable.

SUMMARY OF THE INVENTION

The present invention has been made in consideration of the above problems, and has its feature to provide a printing apparatus and its control method which realize high-speed and high-quality image printing.

According to the present invention, provided is a printing apparatus which performs printing using a printhead having plural printing elements, comprising: print data addition device configured to add print data corresponding to a defective printing element among the plural printing elements to print data corresponding to at least one adjacent normal printing element; mask device configured to mask the print data corresponding to the defective printing element; and printing device configured to perform printing based on the print data as a result of addition by the print data addition device and the print data masked by the mask device.

Further, according to the present invention, provided is a printing apparatus control method for controlling a printing apparatus which performs printing using a printhead having plural printing elements, comprising: a print data addition step of adding print data corresponding to a defective printing element among the plural printing elements to print data corresponding to at least one adjacent normal printing element; a mask step of masking the print data corresponding to the defective printing element; and a printing step of performing printing based on the print data as a result of addition at the print data addition step and the data masked at the mask step.

Other features and advantages of the present invention will be apparent from the following description taken in conjunction with th accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Hereinbelow, preferred embodiments of the present invention will now be described in detail in accordance with the accompanying drawings. Note that in the following embodiments, a printer is used as an ink-jet printing apparatus.

In this specification, the terms "print" and "printing" not only include the formation of significant information such as characters and graphics, but also broadly include the formation of images, figures, patterns and the like on a printing medium, or the processing of the medium, regardless of whether they are significant or insignificant and whether they are so visualized as to be visually perceivable by humans.

Also, the term "printing medium" not only includes a paper sheet used in common printing apparatuses, but also broadly includes materials, such as cloth, a plastic film, a metal plate, glass, ceramics, wood and leather, capable of accepting ink.

Furthermore, the term "ink" (to be also referred to as "liquid" hereinafter) should be broadly interpreted similar to the definition of "print" described above. That is, "ink" includes a liquid which, when applied onto a printing medium, can form images, figures, patterns and the like, can process the printing medium, and can process ink (e.g., can solidify or insolubilize a coloring agent contained in ink applied to the printing medium).

(1) Color Printing Apparatus

Figure 5:
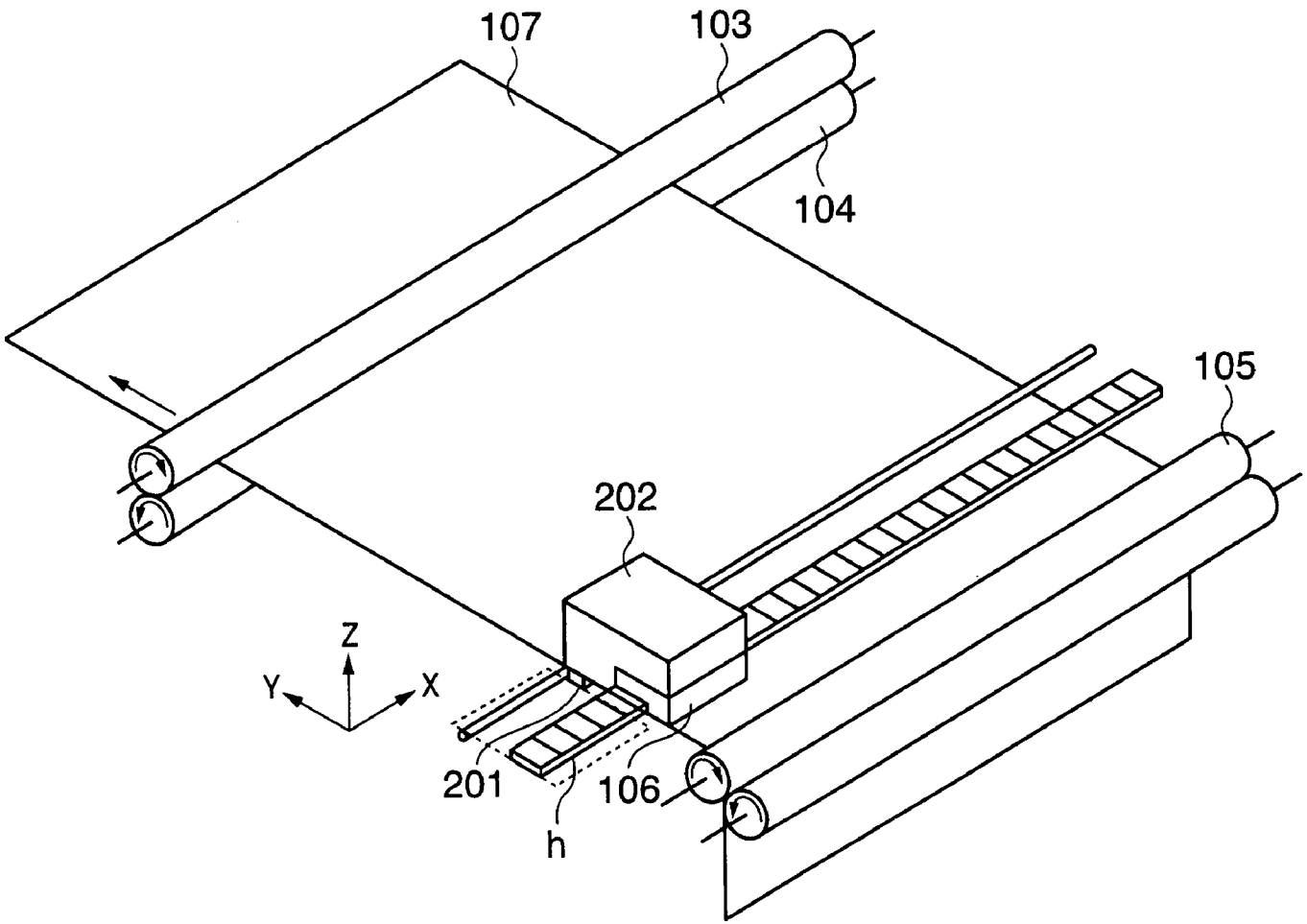
FIG. 5 is a schematic perspective view showing the structure of a color ink-jet printing apparatus to which the present invention is applicable.

FIG. 5 is a schematic perspective view showing the structure of a color ink-jet printing apparatus to which the present invention is applicable.

In FIG. 5, reference numeral 202 denotes ink cartridges having ink tanks containing 4 color inks (black, cyan, magenta and yellow) and printheads 201. Numeral 103 denotes a paper feed roller which rotates in an arrow direction in the figure while pressing, with an auxiliary roller 104, a print sheet 107, thus feeds the print sheet 107. The rollers 103 and 104 also hold the print sheet 107. Numeral 106 denotes a carriage, supporting the 4 ink cartridges 202, which moves the ink cartridges 202 and the printheads 201 upon printing. When the printing apparatus does not perform printing or recovery operation is performed on the printheads, the carriage 106 stands by in a home position indicated with a dotted line in the figure.

Prior to printing, when a print start command is received, the carriage 106 in the position in the figure (home position) drives printing elements provided in the printheads 201 while moving in an x direction, to perform printing in an area corresponding to a print width of the printhead on the print sheet. When the printing to an end of the print sheet along a carriage scanning direction has been completed, the carriage returns to the home position and performs printing in the x direction again. After the completion of the previous print scanning and before the start of the next print scanning, the paper feed roller 103 rotates in the arrow direction in the figure to feed the print sheet in a y direction by a necessary width. In this manner, the main scanning and paper feeding are repeated, thereby printing on the print sheet is completed. A print operation of discharging ink from the printhead is performed under the control of print control means (not shown).

Further, to increase a printing speed, it may be arranged such that in addition to printing upon main scanning in a forward movement of the carriage, printing is also performed in a backward movement of the carriage after the printing upon main scanning in the x direction to the home position.

Further, in the above-described example, the ink tanks and the printheads are separably held on the carriage 106, however, an ink-jet cartridge, where the ink tanks 202 containing inks and the printheads 201 to discharge ink toward the print sheet 107 are integrally formed, may be employed. Further, a printhead where plural color inks are discharged from 1 printhead may be employed.

Further, capping means (not shown) for capping a front surface (discharge orifice surface) of the head, and a recovery unit (not shown) to perform a head recovery operation of removing viscosity-increased ink and bubbles in the printhead capped by the capping means are provided in the position to perform the above-described recovery operation. Further, a cleaning blade (not shown) or the like, is supported on the side of the capping means, projectable toward the printhead 201, into contact with the front surface of the printhead. In this arrangement, after the recovery operation, the cleaning blade is projected in a path of movement of the printhead, and along with the movement of the printhead, unnecessary ink droplets and impurities on the front surface of the printhead can be removed.

(2) Printhead

Next, the above-described printhead 201 will be described with reference to FIG. 6.

Figure 6:
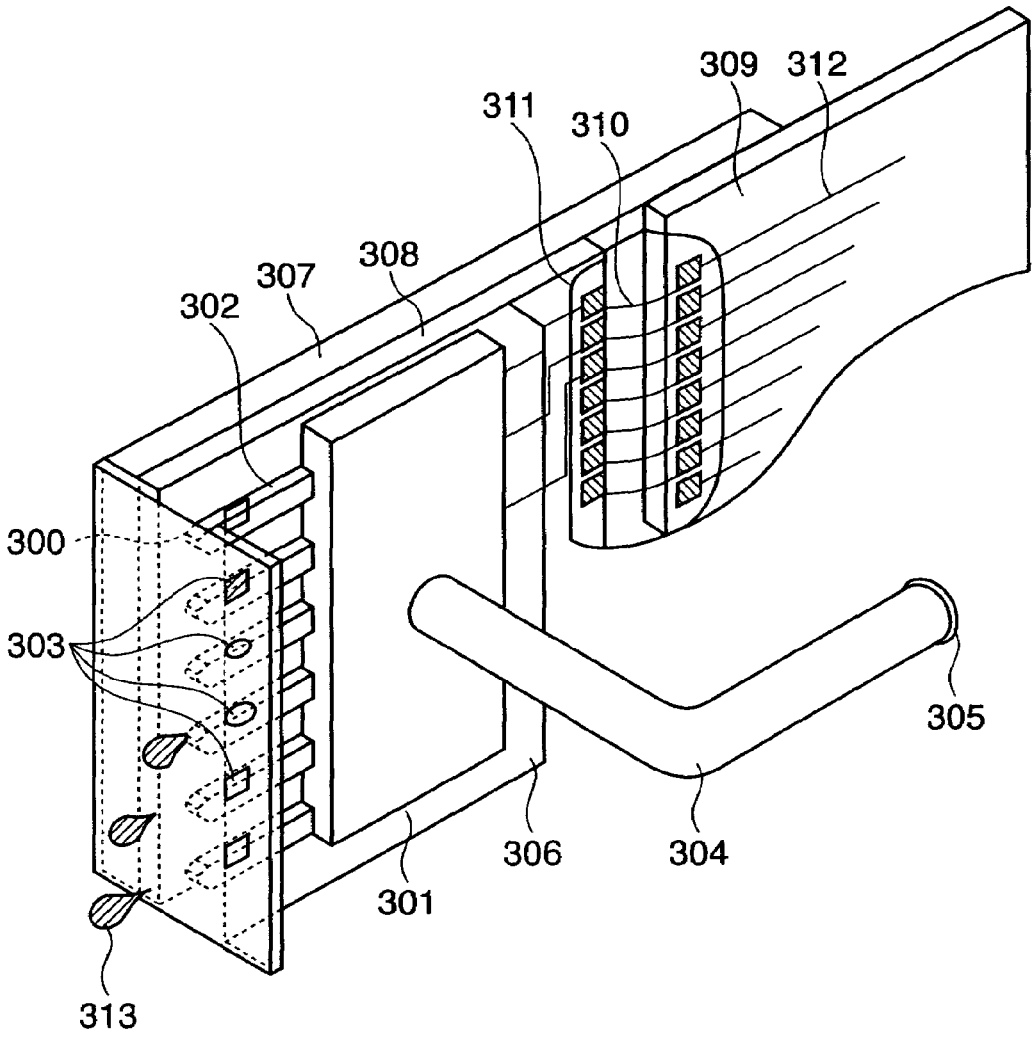
FIG. 6 is a perspective view showing principal elements of a printhead to which the present invention is applicable.

FIG. 6 is a perspective view showing principal elements of the printhead 201 in FIG. 5.

As shown in FIG. 5, in the printhead 201, plural discharge orifices 300 are formed at predetermined pitch, and printing elements 303 to generate energy for ink discharge are provided along wall surfaces of respective liquid channels 302 connecting a common liquid chamber 301 and the respective discharge orifices 300. The printing element 303 and its circuit are formed by utilizing a semiconductor forming technique on a silicon plate 308. The silicon plate 308 on which these electrical wirings are formed is bonded to an aluminum base plate 307.

Further, a circuit connection member 311 and a print board 309 on the silicon plate 308 are connected with microwires 310, and a signal from a printing apparatus main body is received via a signal circuit 312. The liquid channels 302 and the common liquid chamber 301 are formed in an injection molded plastic cover 306.

The common liquid chamber 301 is connected to the above-described ink tank (See FIG. 5) via a joint pipe 304 and an ink filter 305. The common liquid chamber 301 is supplied with ink from the ink tank.

The ink, supplied from the ink tank to the common liquid chamber 301 and temporarily stored there, penetrates by capillary phenomenon into the liquid channels 302, and forms meniscuses at the discharge orifices 300, maintaining the ink-filled state in the liquid channels 302. At this time, when the printing elements 303 are energized via electrodes (not shown) and generate heat, the ink on the printing elements 303 are quickly heated and bubbles are generated in the liquid channels 302, then ink droplets 313 are discharged from the discharge orifices 300 by expansion of the bubbles.

Figure 8:
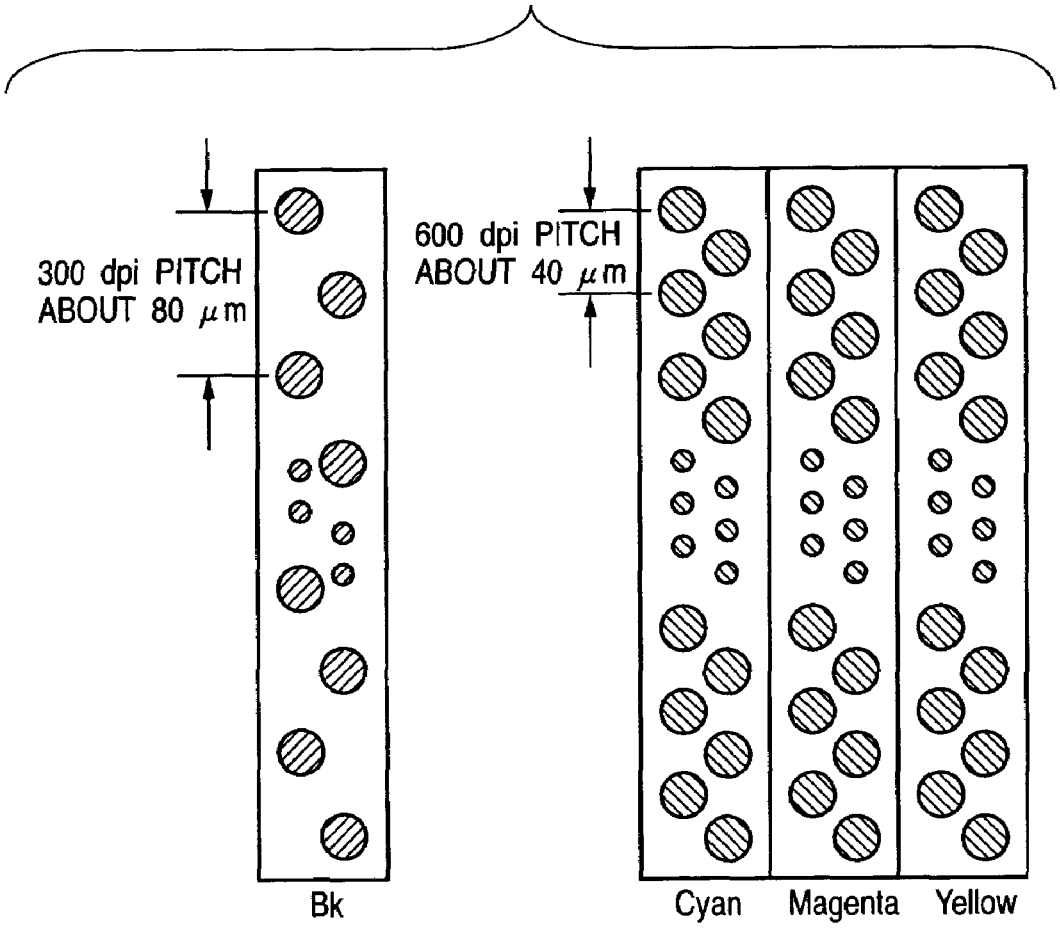
FIG. 8 is an explanatory view showing nozzle structures of the printheads according to the first embodiment.

FIG. 8 is an explanatory view showing nozzle structures of the printheads. A Bk printhead has 2 nozzle arrays (total 640 nozzles), each having 320 nozzles provided at a pitch (about 80 $\mu$m) corresponding to a resolution of 300 dpi, shifted from each other (by about 40 $\mu$m), realizing a resolution of 600 dpi.

On the other hand, cyan, magenta and yellow printheads respectively have 2 nozzle arrays (total 1280 nozzles), each having 640 nozzles provided at a pitch (about 40 $\mu$m) corresponding to the resolution of 600 dpi, shifted from each other (by about 20 $\mu$m), realizing a resolution of 1200 dpi.

(3) Control Construction

Next, a control construction for execution of print controls in the respective elements of the apparatus will be described with reference to the block diagram of FIG. 7.

Figure 7:
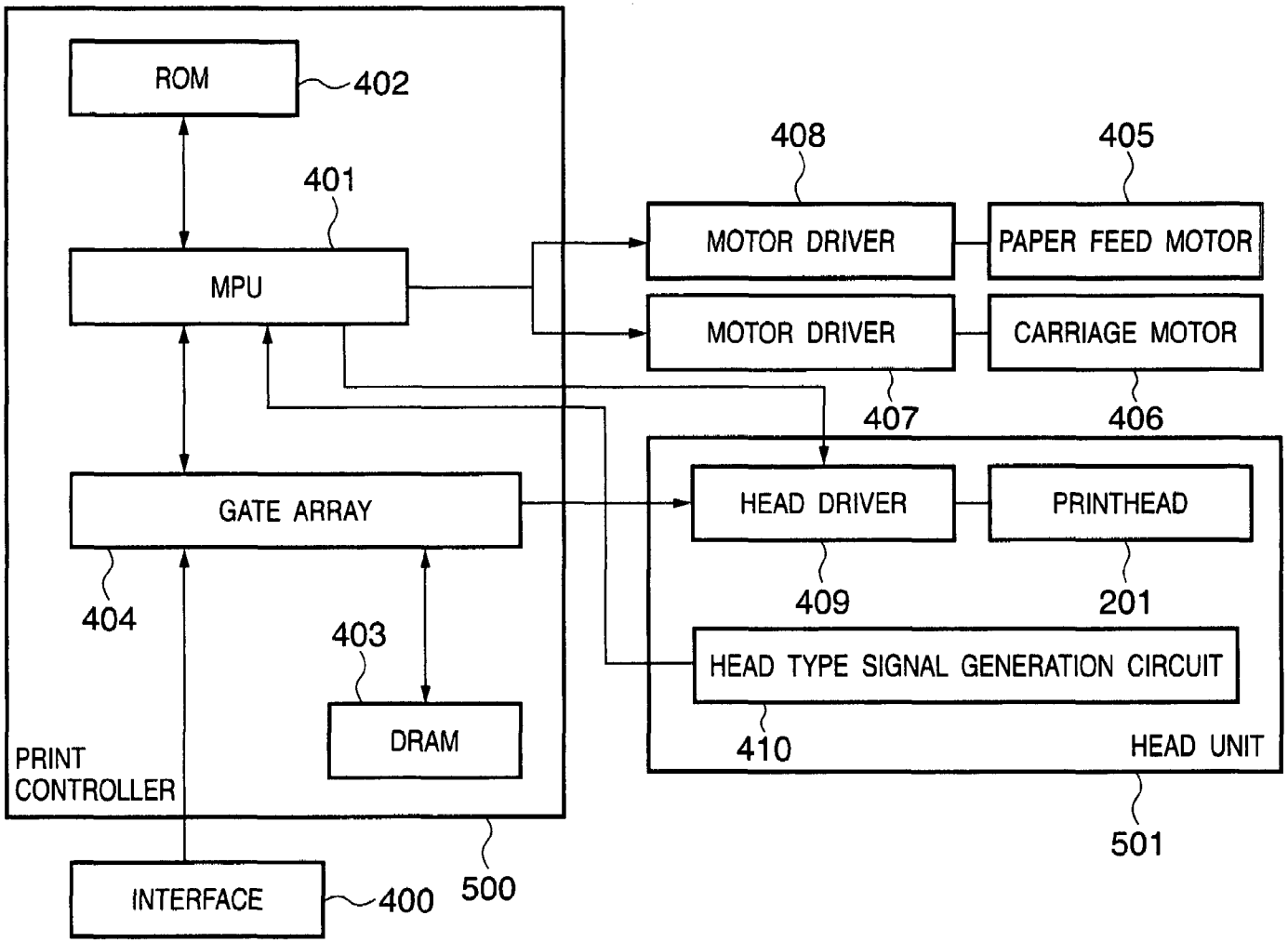
FIG. 7 is a block diagram showing a control construction of the ink-jet printing apparatus to which the present invention is applicable.

In FIG. 7 showing a control circuit, numeral 400 denotes an interface to input a print signal; 401, an MPU; 402, a program ROM for storing a control program executed by the MPU 401; and 403, a dynamic RAM (DRAM) for storing various data (the print signal, print data supplied to the head and the like), in which the number of print dots, the number of exchanges of printhead and the like can be stored.

Numeral 404 denotes a gate array to control print data supply to the printhead, and control data transfer among the interface 400, the MPU 401 and the DRAM 403; 405, a carrier motor (CR motor) to convey the printhead; 406, a conveyance motor (LF motor) to convey a print sheet; 407 and 408, motor drivers to drive the carrier motor 405 and the conveyance motor 406; and 409, a head driver to drive a printhead 410.

[First Embodiment]

In the printing apparatus according to a first embodiment of the present invention, data corresponding to a defective printing element is added to data corresponding to adjacent normal printing element, and 1-path printing is performed. By this arrangement, an image where a white line is inconspicuous can be printed without reduction of throughput.

Figure 9:
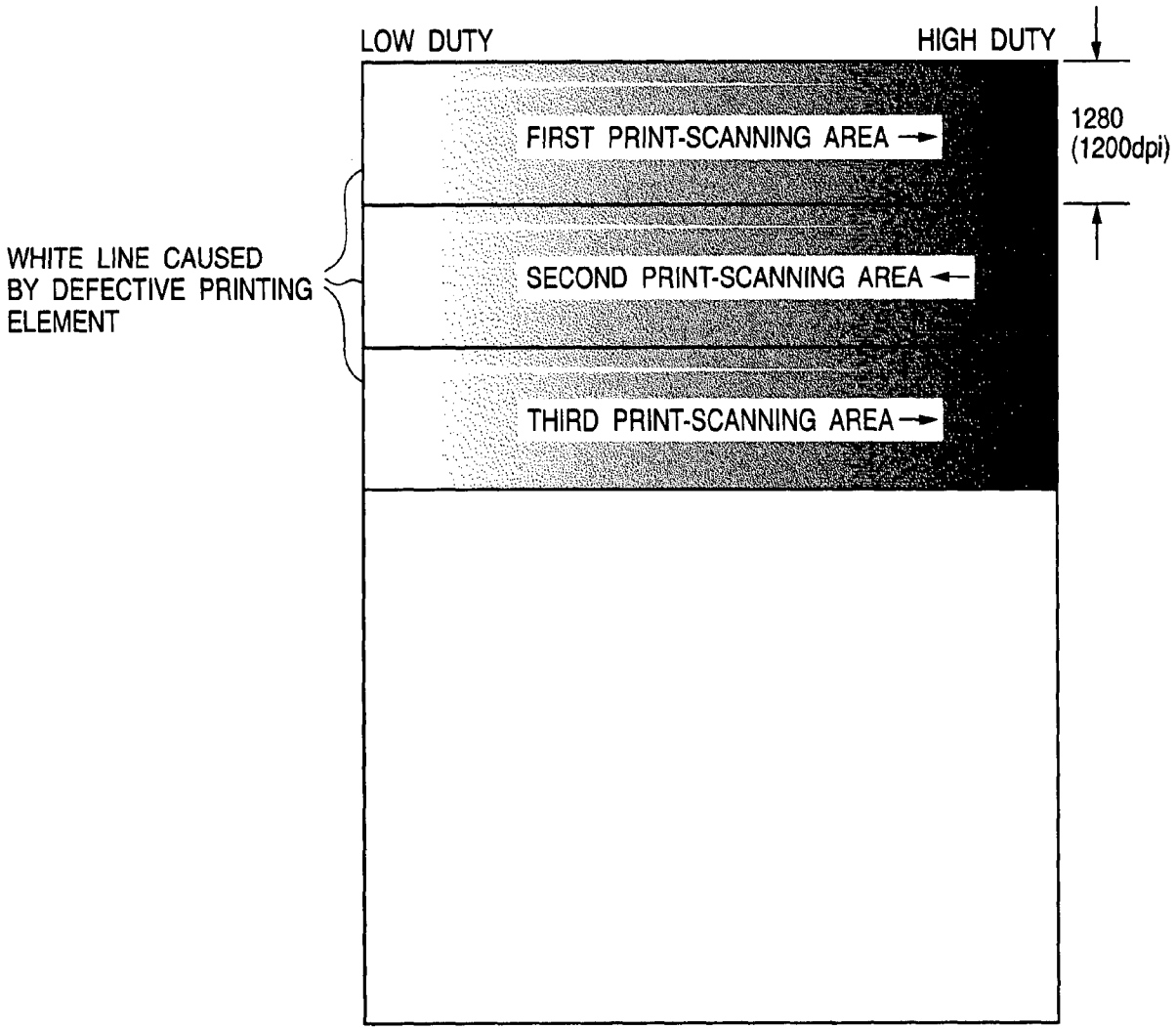
FIG. 9 is an explanatory view of 1-path bidirectional printing.

First, 1-path bidirectional printing will be described with reference to FIG. 9.

The 1-path bidirectional printing is a method of print-outputting all the data in a print area printable by 1 print scanning by alternately repeating paper feeding by a print width (1280 nozzles) and reciprocated print scanning, thereby completing an image.

Generally, in an ink-jet printing apparatus, 1-path printing is performed in a mode of high-speed printing on normal paper. In this case, permeable type ink is often used for prevention of mixture among color inks.

In use of this type of ink, as ink is blurred on the paper surface, a white line caused by a poor discharging (or non-discharging) nozzle is more conspicuous in a low-duty image area than in a high-duty image area.

Accordingly, in a case where an on-bit exists in raster data corresponding to a normal printing element adjacent to a defective printing element and an area around the defective printing element is comparatively a high duty area, the white line is comparatively inconspicuous even if raster data corresponding to the defective printing element cannot be complemented. On the other hand, in a case where on-bit does not exist in the raster data corresponding to the normal printing element adjacent to the defective printing element and the area around the defective printing element is comparatively a low duty area, as the raster data corresponding to the defective printing element can be complemented, the white line can be improved.

Figure 1:
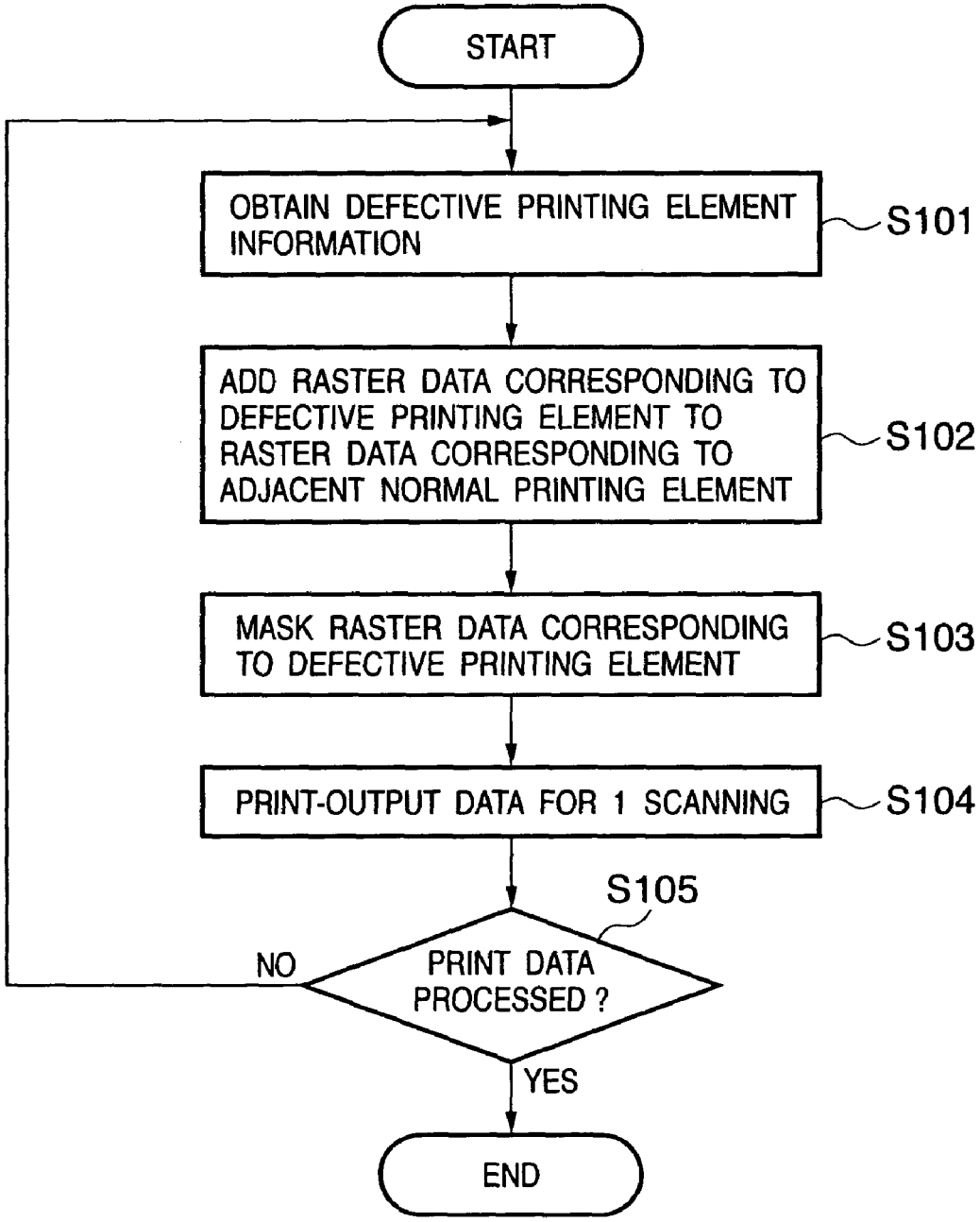
FIG. 1 is a flowchart showing poor discharge complementary processing according to a first embodiment of the present invention.

Next, complementary processing will be described. FIG. 1 is a flowchart showing the complementary processing according to the present embodiment.

In FIG. 1, when the processing is started, first, defective printing element information is obtained (S101). In the present embodiment, the defective printing element information is held on an EEPROM as a non-volatile memory of the printhead or the printing apparatus main body. Further, the defective printing element may be detected upon shipment of printhead, otherwise, the printing apparatus may be provided with well-known detection means for detection at predetermined timing.

Next, raster data corresponding to the defective printing element is added to raster data corresponding to an adjacent normal printing element (S102). The addition of raster data is made by OR processing between the raster data corresponding to the normal printing element and the raster data corresponding to the defective printing element.

Next, the raster data corresponding to the defective printing element is masked for prevention of print-outputting of the data (S103).

Finally, data for 1 scanning is print-outputted based on the processed raster data (S104).

Note that when data for all the scannings has been print-outputted, the process ends, otherwise, the above-described processing is repeated (S105).

Figure 2:
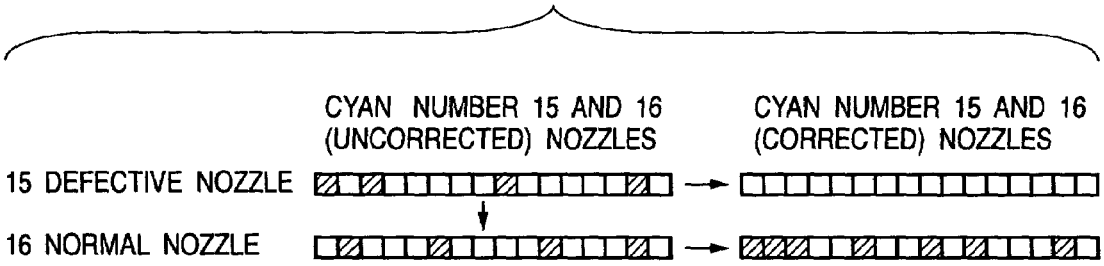
FIG. 2 is an explanatory view of the poor discharge complementary data processing according to the first embodiment.

Next, complementary data processing will be described. FIG. 2 is an explanatory view of the complementary data processing according to the present embodiment.

In the present embodiment, it is assumed that a cyan number 15 nozzle is a defective one, and a cyan number 16 nozzle is a normal one.

First, OR processing is performed between raster data corresponding to the number 15 nozzle and that corresponding to the adjacent number 16 nozzle, and corrected data corresponding to the number 16 nozzle is obtained. At the same time, the raster data corresponding to the number 15 nozzle, which is a defective nozzle, is masked, as null data after the correction. An ink is not discharged in terms of null data.

If there is isolated dot data representing a dot without peripheral dots in the raster data corresponding to the number 15 nozzle, a white spot in printed image can be improved by complementary printing with the number 16 nozzle.

Further, regarding a pixel for which the bit is on in both raster data corresponding to the number 15 nozzle and the number 16 nozzle, the problem of data omission still remains, however, since the data omission does not correspond to vertical two pixels, there is almost no problem in 1-path printing on normal paper where inks are comparatively easily blurred.

As described above, according to the present embodiment, prior to printing, data corresponding to a defective printing element is added to data corresponding to an adjacent normal printing element. In this arrangement, even if a defective printing element exists, an image in which the problem of a white line is resolved can be printed out by 1-path printing.

[Second Embodiment]

In the printing apparatus according to a second embodiment of the present invention, data corresponding to a defective printing element is distributed between data corresponding to both adjacent normal printing elements, and 1-path printing is performed. In this arrangement, the durability of the both adjacent normal printing elements can be improved.

In the present embodiment, as the basic processing and construction are the same as those of the first embodiment, only complementary data processing different from that of the first embodiment will be described.

Figure 3:
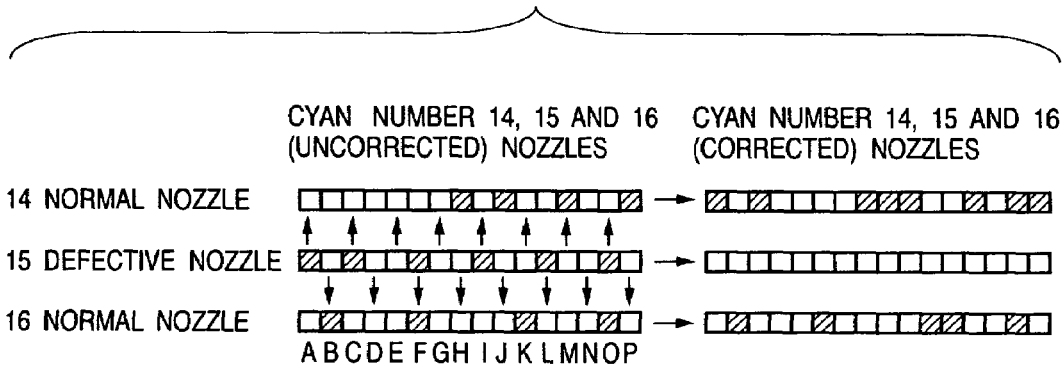
FIG. 3 is an explanatory view of the poor discharge complementary data processing according to a second embodiment of the present invention.

FIG. 3 is an explanatory view of the complementary data processing according to the present embodiment.

In the present embodiment, the cyan number 15 nozzle is a defective nozzle, and the cyan number 14 nozzle and the cyan number 16 nozzle are normal nozzles. The addresses of data corresponding to the respective nozzles are A, B, C, . . . , P.

First, OR processing is performed between bit data at address A corresponding to the number 15 nozzle and that at address A corresponding to the number 14 nozzle. Then OR processing is performed between bit data at address B corresponding to the number 15 nozzle and that at address B corresponding to the number 16 nozzle. Thus OR processing is sequentially performed between bit data of the raster data corresponding to the number 15 nozzle and the raster data corresponding to the number 14 and number 16 nozzles, thereby complemented raster data corresponding to the number 14 and number 16 nozzles can be obtained.

In the present embodiment, the raster data corresponding to the number 15 nozzle is sequentially distributed regardless of on/off state of bit data for simplification of processing, however, it may be arranged such that the on/off state of bit data is detected and sequential distribution is made for only on-bit pixel. The raster data corresponding to the number 15 nozzle, which is a defective nozzle, is masked, as null data after the correction.

In the first embodiment, all the data corresponding to the number 15 nozzle is print-outputted using the number 16 nozzle. In the second embodiment, as the data corresponding to the number 15 nozzle is equally distributed between the number 14 and number 16 nozzles, the frequency of use per nozzle can be reduced and the durability of the printhead can be improved.

As described above, according to the present embodiment, prior to printing, data corresponding to a defective printing element is distributed between data corresponding to both adjacent normal printing elements. In this arrangement, even if a defective printing element exists, an image in whish the problem of a white line is resolved can be printed out by 1-path printing, and further, the durability of the printhead can be improved.

[Third Embodiment]

In the printing apparatus according to a third embodiment, data corresponding to a defective printing element is appropriately distributed between data corresponding to both adjacent normal printing elements, and 1-path printing is performed. In this arrangement, data omission can be minimized.

In the present embodiment, as the basic processing and construction are the same as those of the first embodiment, only complementary data processing different from that of the first embodiment will be described.

Figure 4:
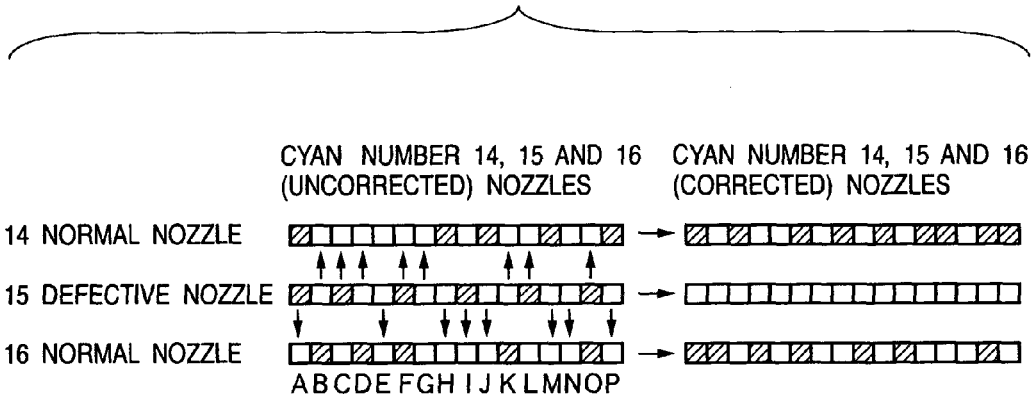
FIG. 4 is an explanatory view of the poor discharge complementary data processing according to a third embodiment of the present invention.

The complementary data processing will be described with reference to FIG. 4.

In the present embodiment, the cyan number 15 nozzle is a defective nozzle, and the cyan number 14 nozzle and the cyan number 16 nozzle are normal nozzles. The addresses of data corresponding to the respective nozzles are A, B, C, . . . , P.

In the raster data corresponding to the number 14 and 16 nozzles, pixels (addresses) where both bits are on or off are C, E, G, I, L and N. In the raster data corresponding to the number 15 nozzle, data of these pixels (addresses) are sequentially distributed between the number 14 and 16 nozzles. In this embodiment, as the data is sequentially distributed regardless of on/off state of bit data in the raster data corresponding to the number 15 nozzle for simplification of processing, however, it may be arranged such that on/off state of bit data is detected and sequential distribution is made for only on-bit pixel.

On the other hand, in the raster data corresponding to the number 14 and 16 nozzles, pixels (addresses) where one of the bits is on are A, B, D, F, H, J, K, M, O and P. In the raster data corresponding to the number 15 nozzle, these data are added to data of nozzle where the bit is not on. In this embodiment, as the data is sequentially distributed regardless of on/off state of bit data in the raster data corresponding to the number 15 nozzle for simplification of processing, however, it may be arranged such that on/off state of bit data is detected and sequential distribution is made for only on-bit pixel.

In the present embodiment, data obtained by adding the pixel data A, H, J, M and P to the raster data corresponding to the number 16 nozzle, and the pixel data B, D, F, K and O to the raster data corresponding to the number 14 nozzle, is corrected data.

The raster data corresponding to the number 15 nozzle, which is a defective nozzle, is masked, as null data after the correction.

In the second embodiment, the data is equally distributed to the number 14 and number 16 nozzles. In the third embodiment, the on/off state of data corresponding to the number 14 and 16 nozzles is determined, and the data corresponding to the number 15 nozzle is distributed between the number 14 and number 16 nozzles based on the determination. Accordingly, data omission can be prevented to the utmost.

As described above, according to the present embodiment, prior to printing, data corresponding to a defective printing element is appropriately distributed between data corresponding to both adjacent normal printing elements. In this arrangement, as the durability of the printhead can be improved and data omission can be prevented to the utmost, an image in which a white line is inconspicuous can be printed out by 1-path printing.

[Other Embodiment]

The present invention can be applied to a system constituted by a plurality of devices (e.g., a host computer, an interface, a reader and a printer) or to an apparatus comprising a single device (e.g., a copy machine or a facsimile apparatus).

Further, the object of the present invention can also be achieved by providing a storage medium (or recording medium) holding software program code for performing the aforesaid processes to a system or an apparatus, reading the program code with a computer ( .g., CPU, MPU) of the system or apparatus from the storage medium, then executing the program. In this case, the program code read from the storage medium realizes the functions according to the embodiments, and the storage medium holding the program code constitutes the invention. Furthermore, besides aforesaid functions according to the above embodiments are realized by executing the program code which is read by a computer, the present invention includes a case where an OS (operating system) or the like working on the computer performs a part or entire actual processing in accordance with designations of the program code and realizes functions according to the above embodiments.

Furthermore, the present invention also includes a case where, after the program code read from the storage medium is written in a function expansion card which is inserted into the computer or in a memory provided in a function expansion unit which is connected to the computer, CPU or the like contained in the function expansion card or unit performs a part or entire process in accordance with designations of the program code and realizes functions of the above embodiments.

In a case where the present invention is applied to the aforesaid storage medium, the storage medium stores program cod and various tables corresponding to the flowchart described in FIG. 1.

As described above, according to the above embodiments, the present invention provides a printing apparatus capable of printing an image where a white line is inconspicuous without reducing the throughput by adding data corresponding to a defective printing element to data corresponding to an adjacent normal printing element.

Note that, in the description of the above embodiments, a liquid droplet discharged from the printhead is ink, and the liquid stored in the link tank is also ink. However, the liquid stored in the ink tank is not limited to ink. For example, the ink tank may store a processed liquid to be discharged onto a print medium so as to improve fixability and water repellency of a printed image or to improve its image quality.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Published Unexamined Patent Application No. 59-123670 which discloses the arrangement using a slot common to a plurality of electrothermal transducers as a discharge portion of the electrothermal transducers, or Japanese Published Unexamined Patent Application No. 59-138461 which discloses the arrangement having an opening for absorbing a pressure wave of heat energy in correspondence with a discharge portion.

In addition, not only a cartridge type printhead in which an ink tank is integrally arranged on the printhead itself but also an exchangeable chip type printhead, as described in the above embodiments, which can be electrically connected to the apparatus main unit and can receive an ink from the apparatus main unit upon being mounted on the apparatus main unit can be applicable to the present invention.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In this case, ink may be situated opposite electrothermal transducers while being held in a liquid or solid state in recess portions of a porous sheet or through holes, as described in Japanese Published Unexamined Patent Application No. 54-056847 or 60-071260. In the present invention, the above-mentioned film boiling system is most effective for the above-mentioned inks.

In addition, the ink-jet printer of the present invention may be used in the form of a copying machine combined with a reader and the like, or a facsimile apparatus having a transmission/reception function in addition to an image output terminal of an information processing apparatus such as a computer.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus which performs printing using a printhead having plural printing elements, comprising:

print data addition device configured to add print data corresponding to a defective printing element among said plural printing elements to print data corresponding to at least one normal printing element adjacent to the defective printing element;

mask device configured to mask the print data corresponding to said defective printing element; and printing device configured to perform printing based on the print data as a result of addition by said print data addition device and the print data masked by said mask device.

2. The printing apparatus according to claim 1, wherein said printing device prints an image by 1-path printing.

3. The printing apparatus according to claim 1, wherein said print data addition device adds the print data corresponding to said defective printing element to print data corresponding to one adjacent normal printing element.

4. The printing apparatus according to claim 1, wherein said mask device masks the print data corresponding to said defective printing element with 0 as null data.

5. The printing apparatus according to claim 1, wherein said print data addition device sequentially distributes the print data corresponding to said defective printing element between print data corresponding to two adjacent normal printing elements.

6. The printing apparatus according to claim 1, wherein said print data addition device detects on/off states of print data corresponding to two adjacent normal printing elements and distributes the print data corresponding to said defective printing element based on the result of detection.

7. The printing apparatus according to claim 6, wherein detection of on/off states of the print data is made as a case where one of the data corresponding to the two adjacent normal printing elements is on or off, and wherein if one of the data corresponding to the two adjacent normal printing elements is on, said print data addition device adds the data corresponding to said defective printing element to off data of the data corresponding to the two adjacent normal printing elements, while if one of the data corresponding to the two adjacent normal printing elements is off, said print data addition device sequentially distributes the data corresponding to said defective printing element between the data corresponding to the two adjacent normal printing elements.

8. A printing apparatus control method for controlling a printing apparatus which performs printing using a printhead having plural printing elements, comprising:

a print data addition step of adding print data corresponding to a defective printing element among said plural printing elements to print data corresponding to at least one normal printing element adjacent to the defective printing element;

a mask step of masking the print data corresponding to said defective printing element; and a printing step of performing printing based on the print data as a result of addition at said print data addition step and the data masked at said mask step.

9. The printing apparatus control method according to claim 8, wherein at said printing step, an image is printed by 1-path printing.

10. The printing apparatus control method according to claim 8, wherein at said print data addition step, the print data corresponding to said defective printing element is added to print data corresponding to one adjacent normal printing element.

11. The printing apparatus control method according to claim 8, wherein at said mask step, the print data corresponding to said defective printing element is masked with 0 as null data.

12. The printing apparatus control method according to claim 8, wherein said print data addition step, the print data corresponding to said defective printing element is sequentially distributed between print data corresponding to two adjacent normal printing elements.

13. The printing apparatus control method according to claim 8, wherein at said print data addition step, on/off states of print data corresponding to two adjacent normal printing elements are detected and the print data corresponding to said defective printing element is distributed based on the result of detection.

14. The printing apparatus control method according to claim 13, wherein detection of on/off states of the print data is made as a case where one of the data corresponding to the two adjacent normal printing elements is on or off, and wherein if one of the data corresponding to the two adjacent normal printing elements is on, the data corresponding to said defective printing element is added to off data of the data corresponding to the two adjacent normal printing elements at said print data addition step, while if one of the data corresponding to the two adjacent normal printing elements is off, the data corresponding to said defective printing element is sequentially distributed between the data corresponding to the two adjacent normal printing elements at said print data addition step.

15. A control program for a printing apparatus which performs printing using a printhead having plural printing elements, for realizing functions of performing:

a print data addition step of adding print data corresponding to a defective printing element among said plural printing elements to print data corresponding to at least one normal printing element adjacent to the defective printing element;

a mask step of masking the print data corresponding to said defective printing element; and a printing step of performing printing based on the print data as a result of addition at said print data addition step and the data masked at said mask step.

16. A computer-readable storage medium holding a control program for a printing apparatus which performs printing using a printhead having plural printing elements, or realizing functions of performing:

a print data addition step of adding print data corresponding to a defective printing element among said plural printing elements to print data corresponding to at least one normal printing element adjacent to the defective printing element;

a mask step of masking the print data corresponding to said defective printing element; and a printing step of performing printing based on the print data as a result of addition at said print data addition step and the data masked at said mask step.

17. A printing apparatus which performs printing using printhead having plural printing elements, comprising:

print data addition means for adding print data corresponding to a defective printing element among said plural printing elements to print data corresponding to at least one normal printing element adjacent to the defective printing element;

mask means for masking the print data corresponding to said defective printing element; and printing means for performing printing based on the print data as a result of addition by said print data addition device and the print data masked by said mask device.

* * * * *

UNITED STATES PATENT AND TRADEMARK OFFICE

CERTIFICATE OF CORRECTION

PATENT NO. : 6,979,068 B2
DATED : December 27, 2005
INVENTOR(S) : Daigoro Kanematsu It is certified that error appears in the above-identified patent and that said Letters Patent is hereby corrected as shown below:

Column 2,
Line 37, replace "Publish d" with -- Published --.

Column 3,
Line 21, replace "th" with -- the --.

Column 9,
Line 39, replace "( .g, CPU, MPU)" with -- (e.g., CPU, MPU) --; and
Line 63, replace "cod" with -- code --.

Signed and Sealed this

Twenty-eighth Day of March, 2006

JON W. DUDAS
*Director of the United States Patent and Trademark Office*